United States Patent [19]

Hirt

[11] 4,256,065

[45] Mar. 17, 1981

[54] ARRANGEMENT FOR THE CONTROLLABLE OPERATION OF VALVES

[75] Inventor: Dieter Hirt, Augsburg, Fed. Rep. of Germany

[73] Assignee: Maschinenfabrik Augsburg-Nürnberg Aktiengesellschaft, Munich, Fed. Rep. of Germany

[21] Appl. No.: 966,212

[22] Filed: Dec. 4, 1978

[30] Foreign Application Priority Data

Dec. 8, 1977 [DE] Fed. Rep. of Germany ..... 2754624

[51] Int. Cl.[3] ..... F16K 31/10; F01L 1/00

[52] U.S. Cl. ..... 123/90.11; 251/138; 251/129; 74/57; 74/424.8 VA; 74/424.8 R

[58] Field of Search ..... 123/90.11, 90.1; 251/133, 132, 138; 74/424.8 VA, 57, 424.8 R

[56] References Cited

U.S. PATENT DOCUMENTS

| | | | |
|---|---|---|---|
| 2,253,716 | 8/1941 | Martin | 192/94 X |
| 2,824,460 | 2/1958 | Davis | 251/133 X |
| 3,258,985 | 7/1966 | Jordan | 251/134 X |
| 3,640,140 | 2/1972 | Gulick et al. | 74/424.8 VA |
| 3,856,042 | 12/1974 | Fletcher et al. | 74/424.8 VA |
| 3,882,833 | 5/1975 | Longstaff et al. | 123/90.11 |
| 3,955,792 | 5/1976 | Cho | 251/138 X |
| 4,114,465 | 9/1978 | Troy | 251/133 X |

FOREIGN PATENT DOCUMENTS

| | | | |
|---|---|---|---|
| 963698 | 7/1964 | United Kingdom | 251/133 |

*Primary Examiner*—Arnold Rosenthal
*Attorney, Agent, or Firm*—Scully, Scott, Murphy & Presser

[57] ABSTRACT

Arrangement for the controllable operation of valves, including mechanically cooperating elements powered by external energy and acting on the valve. An electromagnetic control device produces a positive force interengagement of the mechanical elements so as to effect the actuation of the valve.

8 Claims, 2 Drawing Figures

ARRANGEMENT FOR THE CONTROLLABLE OPERATION OF VALVES

BACKGROUND OF THE INVENTION

1. Field of the Invention

The present invention relates to valves and, more particularly, an arrangement for the controllable operation of valves.

Valves are employed in the most widely differing designs in practically all technical fields. In many instances it is necessary to exercise an accurate control over the valves.

In valves whose operating cycle must be effectuated pursuant to a predetermined schedule, the precision with which this schedule is carried out will affect the entire system which is controlled by the valves. Thus, for instance, the efficiency of an internal combustion engine is influenced, among other factors, by the operation of the intake and exhaust valves.

2. Discussion of the Prior Art

It has been attempted to equip valves of that type with control mechanisms so as to be able to correlate the operation thereof as closely as possible with the requirements. In connection therewith, an electrohydraulic valve control system has become known with an electrically-hydraulically actuated valve control system which includes electrically controllable magnetic valves which exert an effect on a hydraulic actuating system for the actual valve. However, such controllable valve operating systems require a high sophistication in manufacture which is not warranted for such an arrangement when employed in small valve-controlled systems.

SUMMARY OF THE INVENTION

Accordingly, it is a primary object of the present invention to provide for a valve operating system which is simply constructed and, through the intermediary of which, the work cycle of a valve can be adapted as closely as possible to the desired mathematical interrelationship.

Pursuant to a more specific object of the present invention, mechanically cooperating elements exert an effect on the valve and are actuated by external energy, while furthermore there is provided an electromagnetic control system which, through the formation of a positive force between the mechanical elements, causes the actuation of the valve.

A magnetic-mechanical valve operating system of that type can be constructed in a simple manner, and with simple components and with small dimensions. Moreover, the degree of reliability of this system in contrast with that of the known arrangement is considerably higher, inasmuch as in this instance no sealing problems occur, nor is there any fear of fluid losses.

The electromagnetic control system acts directly on the valve operating mechanism rather than, in essence, on a switching system for the external energy supply for activation of the mechanism. The valve operating system is thus continually in a state of readiness and can respond extremely rapidly to the signals from the control system. The mechanical elements involved maintain an idling operation whereby due to the action of a magnetic field and its thereby produced force-locked connection one or more elements of the mechanism produces the desired movement for actuation of the valve control member through at least one mechanical element.

Preferably, the mechanism is so constructed that the elements involved engage in a rotational movement during idling operation and thereby initiate an axial displacement as soon as magnetic forces or magnetic and mechanical forces act on the actuating elements.

The inventive valve operating system is particularly suited for the intake and exhaust valves of internal combustion engines. The accurate control of the valves which is necessary for optimum engine efficiency is afforded by a valve operating system of that type whereby the external energy needed for the valve operating system can concurrently be taken off directly from the engine.

In addition to the foregoing, the valve operating system can also be actuated by a programmed electronic control so that the valve can be precisely controlled in dependence upon several variable functions, such as pressure, gas atmosphere, torque, exhaust gases of internal combustion engines pursuant to the presently optimum interrelationships.

BRIEF DESCRIPTION OF THE DRAWINGS

Further objects and advantages of the present invention are described hereinbelow in connection with an exemplary embodiment of the valve operating system which is particularly adapted for internal combustion engines, preferably diesel engines, and in conjunction with the accompanying drawings; in which.

DETAILED DESCRIPTION

Figure 1:
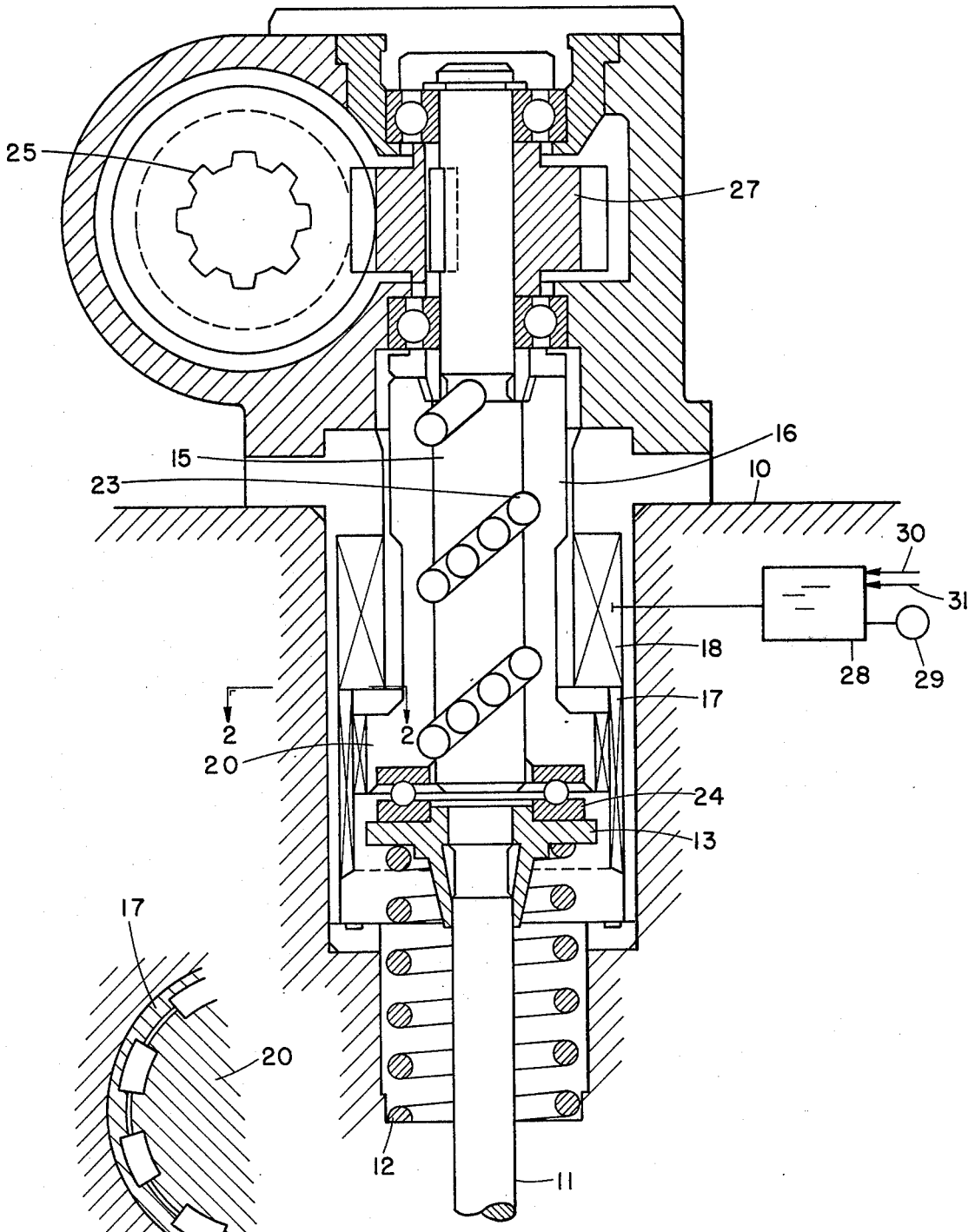
FIG. 1 is a longitudinal section through a valve operating system constructed pursuant to the invention.

FIG. 1 illustrates the inventive embodiment in conjunction with an intake or exhaust valve which is built into a cylinder block 10 and includes a valve stem 11, other valve parts not being detailed for clarity of presentation. The valve stem 11 is equipped with a valve spring head 13 spring-loaded by a valve spring 12.

Figure 2:
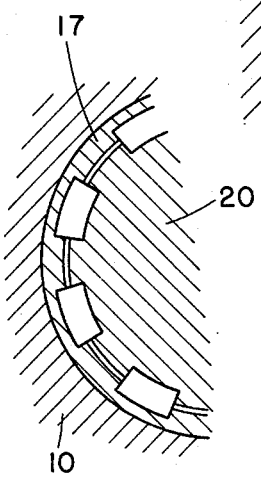
FIG. 2 is a sectional view taken along line 2—2 in FIG. 1.

The valve operating system comprises a mechanical portion having a motor-driven spindle 15 and a ball rolling sleeve 16 connected therewith, and an electromagnetic control system which includes a magnetizable ring gear 17 and an associated solenoid 18. The ring gear 17 is illustrated in greater detail in the sectional view of FIG. 2. A ferromagnetic movable ring gear 20 which is rigidly interconnected with the spindle 15 is in operative interengagement with the stationary ring gear 17. This magnetic coupling forms the actuating member of the control system.

The working cycle of the valve operating system consists of in that the spindle 15 is set into rotation and, in turn, causes the ball rolling sleeve 16 to rotate therewith during the idling condition, in effect, when the valve actuating member is stationary. In order to initiate opening of the valve, the solenoid 18 is electrically energized. As a result the ferromagnetic ring gear 20 which is connected to the sleeve 16 is restrained by the magnetic field forces of the oppositely arranged teeth of the two ring gears 17 and 20. Thereby the further rotating spindle 15 presses the sleeve 16 axially downwardly. This axial displacement is utilized for the actuation of the valve actuating member in that the sleeve, which is positively connected to the valve actuating member, i.e., the valve spring head 13, presses the valve stem 11 downwardly by means of the valve spring head.

In order to render assured the magnetic restraining force throughout the entire displacement of the spindle 15, the stationary magnetic ring gear 17 is constructed so wide as to maintain at full strength the magnetic field during the entire travel of the movable ring gear 20. When the spindle 15 has reached the limit of its displacement, the spindle 15 will impose on the sleeve 16 a moment exceeding the restraining moment of the magnetic field forces through the spiral ball bearing 23 and once again place the sleeve into rotation. An axial ball bearing 24 which is arranged between the sleeve 16 and the valve spring head 13 prevents the transmission of torque to the valve spring head, to the valve closure member. For effecting the closing of the valve, the solenoid 18 is deenergized whereby the magnetic restraining moment dissipates and the sleeve 16 again returns into its original position in response to the force of valve closure spring 12.

The actuation of the spindle 15 can also be presently effectuated by any of the known methods correlated with the respective application. In the example described herein, the spindle is driven using a splined drive shaft 25 arranged above the cylinder heads of the engine block, the drive shaft being driven from the crankshaft, similar to an overhead camshaft through gears, a chain or a toothed belt. This drive shaft 25 causes the spindle 15 of the valve operating system to be set into the necessary rotation through a helical wheel 27.

In a further advantageous aspect of the present invention, the electromagnetic control system can be equipped with a process microcomputer which is powered by an electrical power source 29 and is supplied functional data signals 30, 31 and, after processing of the actual data of the engine operating condition, will correspondingly control the solenoid 18.

What is claimed is:

1. An arrangement for the controllable operation of a valve, comprising mechanically cooperating first and second rotatable members which are movably coupled to each other and are disposed in a relative concentric arrangement, said first rotatable member comprising a shaft, said second member being a hollow cylindrical ball-supporting rolling spindle encompassing said shaft, said first member being driven by external energy, an electromagnetic control means for generating a magnetic field to which said second member is subjected to effect relative movement between said members to cause a force-locked connection coupling said members to effect actuation of the valve, and a valve actuating member being displaced responsive to said relative movement between said first and second members.

2. Arrangement as claimed in claim 1, said mechanical elements being rotatably supported, said relative movement being an axial displacement of at least one of said elements.

3. Arrangement as claimed in claim 1, said valve actuation being initiated by magnetic forces acting on said mechanical elements in one direction and mechanical forces acting in the opposite direction.

4. Arrangement as claimed in claim 1, said electromagnetic control means including a process microcomputer for generating the magnetic field, said process microcomputer being responsive to operating data of a system monitored or controlled by said valve.

5. Arrangement as claimed in claim 1, said mechanical elements being coupled with an engine-powered drive mechanism so as to assume idling operation in the stationary condition of said valve actuating member.

6. Arrangement as claimed in claim 1, said ball-supporting rolling spindle comprising a ferromagnetic rim at its outer circumference, and a stationary electromagnet of said control means facing said rim and cooperating therewith.

7. Arrangement as claimed in claim 6, said ferromagnetic rim including teeth, said stationary electromagnet comprising a ring gear arranged concentrically of the ferromagnetic rim and extending axially over the entire extent of displacement of the rim.

8. Arrangement as claimed in claim 1 for combustion engine valves, wherein the external energy for operating the valve is provided by the internal combustion ngine.

* * * * *